US010961078B2

(12) United States Patent
Kohn

(10) Patent No.: US 10,961,078 B2
(45) Date of Patent: Mar. 30, 2021

(54) MEDICAL EXAMINATION PAPER ROLL

(71) Applicant: Steve Kohn, Short Hills, NJ (US)

(72) Inventor: Steve Kohn, Short Hills, NJ (US)

(73) Assignee: BROADWAY HOLDINGS V, LLC, Monroe, NJ (US)

( * ) Notice: Subject to any disclaimer, the term of this patent is extended or adjusted under 35 U.S.C. 154(b) by 0 days.

(21) Appl. No.: 14/544,634

(22) Filed: Jan. 26, 2015

(65) Prior Publication Data

US 2015/0217959 A1 Aug. 6, 2015

Related U.S. Application Data

(60) Provisional application No. 61/965,322, filed on Jan. 27, 2014.

(51) Int. Cl.

| | |
|---|---|
| ***B65H 75/18*** | (2006.01) |
| ***B65H 16/02*** | (2006.01) |
| ***B65H 18/28*** | (2006.01) |
| ***G09F 23/10*** | (2006.01) |
| ***D21H 27/00*** | (2006.01) |
| ***D21H 21/36*** | (2006.01) |

(52) U.S. Cl.

CPC ..... *B65H 75/187* (2013.01); *B65H 16/021* (2013.01); *B65H 18/28* (2013.01); *D21H 21/36* (2013.01); *D21H 27/002* (2013.01); *G09F 23/10* (2013.01); *Y10T 428/15* (2015.01)

(58) Field of Classification Search

CPC .... B65H 16/021; B65H 18/28; B65H 75/187; B65D 75/002; B65D 75/54; D21H 21/36; D21H 27/002; G09F 23/10

USPC ..... 242/160.1

See application file for complete search history.

(56) References Cited

U.S. PATENT DOCUMENTS

| | | | | | |
|---|---|---|---|---|---|
| 3,567,146 | A * | 3/1971 | Arenson | B65H 75/185 | 242/613.5 |
| 3,810,263 | A * | 5/1974 | Taylor | A61G 7/1032 | 297/223 |
| RE30,168 | E * | 12/1979 | Mason | B65H 75/185 | 206/413 |
| 4,874,139 | A * | 10/1989 | Kewin | B65H 75/187 | 242/609.4 |
| 5,084,927 | A * | 2/1992 | Parkevich | A47G 9/02 | 5/484 |
| 5,913,773 | A * | 6/1999 | Cox | A61G 7/0502 | 5/487 |
| 6,209,463 | B1 * | 4/2001 | Koharchik | A61G 13/0018 | 108/7 |
| 7,341,195 | B2 * | 3/2008 | Cimino | G06F 17/30876 | 235/375 |
| 7,438,254 | B2 * | 10/2008 | Oettershagen | B65B 67/085 | 242/596 |
| 8,268,105 | B2 * | 9/2012 | Bernacchi | B31F 1/07 | 156/209 |
| 8,460,789 | B1 * | 6/2013 | Gift | B32B 7/06 | 428/343 |

(Continued)

*Primary Examiner* — Sang K Kim
*Assistant Examiner* — Nathaniel L Adams
(74) *Attorney, Agent, or Firm* — Weiss & Weiss Attorneys; Philip M. Weiss

(57) ABSTRACT

Medical examination paper rolls that do not have a cardboard core or other device for supporting the full width of the rolled examination paper but instead has a device inserted a limited distance into each edge of the roll to keep it from collapsing, that is easily inserted and removed.

4 Claims, 6 Drawing Sheets

(56) References Cited

U.S. PATENT DOCUMENTS

| | | | | |
|---|---|---|---|---|
| 2003/0234305 | A1* | 12/2003 | Cole | G09F 11/29 242/160.1 |
| 2005/0053644 | A1* | 3/2005 | Salemi | B31D 3/04 424/443 |
| 2005/0079332 | A1* | 4/2005 | Bauer | B32B 27/10 428/211.1 |
| 2005/0092827 | A1* | 5/2005 | Cimino | G06F 17/30876 235/380 |
| 2005/0256773 | A1* | 11/2005 | Cole | G06Q 30/0207 705/14.1 |
| 2006/0081491 | A1* | 4/2006 | Smarr | B65D 85/66 206/397 |
| 2009/0250484 | A1* | 10/2009 | Kling | A47K 10/36 221/14 |
| 2010/0236956 | A1* | 9/2010 | Kling | A47K 10/40 206/391 |
| 2011/0092930 | A1* | 4/2011 | Poorman | A47G 9/0238 604/356 |
| 2011/0114778 | A1* | 5/2011 | Andersson | A47K 10/40 242/160.1 |
| 2012/0030958 | A1* | 2/2012 | Mihalcik | A61B 5/1072 33/701 |
| 2013/0200204 | A1* | 8/2013 | Hassman | B65H 16/005 242/598 |
| 2015/0090779 | A1* | 4/2015 | Malone | G06F 17/30879 235/375 |
| 2016/0214818 | A1* | 7/2016 | Kohn | B65H 18/28 |

* cited by examiner

MEDICAL EXAMINATION PAPER ROLL

RELATED APPLICATIONS

The present application claims priority to provisional patent application No. 61/965,322 filed Jan. 27, 2014.

FIELD OF THE INVENTION

The present invention relates to medical examination paper rolls that do not have a cardboard core or other roll supporting the full width of the rolled examination paper, but instead has a device inserted into each edge of the roll to keep it from collapsing, that is easily inserted and removed.

BACKGROUND OF THE INVENTION

U.S. Pat. No. 7,341,195 relates to a system and method for targeted education and advertising that includes sanitary paper comprising a plurality of portions and a consumer-friendly message disposed on at least one of the plurality of portions. The message preferably comprises health related advertising information. A url is preferably disposed on one of the plurality of portions.

U.S. Pat. No. 8,268,105 relates to a method and apparatus for producing examination table paper rolls that are obtained from a tape of embossed paper, having two layers joined together. The band is obtained from two continuous webs subjected to subsequent steps of embossing, glue application, coupling and stabilization. The method includes applying measured quantities of a sanitizing and/or disinfectant substance between the two layers of embossed paper before their joining.

SUMMARY OF THE INVENTION

The present invention relates to a medical examination roll of paper wherein the roll does not have a cardboard core or other roll support within the opening of the inside diameter of the medical examination paper that goes from one edge of the medical examination paper to the other edge. It is an object of the present invention to place a device into the openings at both edges of the roll of the medical examination paper. The devices only go inside the opening a small distance, for example from about 1" to about 5". The purpose of the device is to keep the medical examination paper in its rolled form without collapsing until it is placed on the examining table at the doctor's office for dispensing.

It is an object of the present invention for the medical examination roll of paper to be shrink wrapped. It is an object of the present invention to put marketing collateral under the shrink wrap and above the roll or on top the shrink wrapped roll.

It is an object of the present invention for the devices to have a gripping piece for easily inserting the device into the openings at each edge of the roll, and for removing the device from the roll of examination paper. The gripping piece extends upward from the recessed portion of the device. The device further comprises a collar around one end which rests on the outside edge of the medical examination paper roll.

It is an object of the present invention for the roll of medical examination paper to have perforations so that the paper can be torn easily. It is an object of the present invention for the perforations to be located at the same precise distance throughout the roll, for example at 6 foot integrals.

It is an object of the present invention to have advertising or games located on both sides of the perforations that are located on the medical examination paper, and no advertising located beyond those locations. This way when a user is sitting on the medical examination paper, they are not sitting on the advertising, but can read or interact with the advertising or games while they are sitting on the medical examination paper.

It is an object of the present invention to place an adhesive or other material where the perforations are located on the underside of the medical examination paper, so that the paper can be attached to the table when the paper is placed on the table. In this way the paper does not move while the user is sitting on the paper, or when the paper is placed on the table.

It is an object of the present invention to coat or impregnate the paper with an anti-fungal and/or anti-microbial agent for protecting the patient from possible contamination caused by unchanged medical examination paper.

It is an object of the present invention for the agent to be used in a concentration so as to act as an anti-fungal and/or anti-microbial agent.

It is an object of the present invention for the anti-fungal and anti-microbial agents to be copper (II) 8-quinolinolate (CAS No. 10380-28-6); zinc oxide (CAS No. 1314-13-2); zinc-dimethyl dithiocarbamate (CAS No. 137-304); 2-mercaptobenzothiazole, zinc salt (CAS No. 155-04-4); barium metaborate (CAS No. 13701-59-2); tributyl tin benzoate (CAS No. 4342-36-3); bis tributyl tin salicylate (CAS No. 22330-14-9); tributyl tin oxide (CAS No. 56-35-9); parabens: ethyl parahydroxybenzoate (CAS No. 120-47-8); propyl parahydroxybenzoate (CAS No. 94-13-3); methyl parahydroxybenzoate (CAS No. 99-76-3); and butyl parahydroxybenzoate (CAS No. 94-26-8); methylenebis (thiocyanate) (CAS No. 6317-18-6); 1,2-benzisothiazoline-3-one (CAS No. 2634-33-5); 2-mercaptobenzothiazole (CAS No. 149-30-4); 5-chloro-2-methyl-3 (2H)-isothiazolone (CAS No. 57373-19-0); 2-methyl-3(2H)-isothiazolone (CAS No. 57373-20-3); zinc 2-pyridinethiol-N-oxide (CAS No. 1346341-7); tetra-hydro-3,5-di-methyl-2H-1,3,5-thiadiazine-2-thione (CAS No. 533-74-4); N-trichloromethyl-thio-4-cyclohexene-1,2-dicarboximide (CAS No. 133-06-2); 2-n-octyl-4-isothiazoline-3-one (CAS No. 26530-20-1); 2,4,5,6-tetrachloro-isophtalonitrile (CAS No. 1897-45-6); 3-iodo-2-propynyl butylcarbamate (CAS No. 55406-53-6); diiodomethyl-p-tolylsulfone (CAS No. 20018-09-1); N-(trichloromethyl-thio)phthalimide (CAS No. 133-07-3); potassium N-hydroxy-methyl-N-methyl-dithiocarbamate (CAS No. 51026-28-9); sodium 2-pyridinethiol-1-oxide (CAS No. 15922-78-8); 2-(thiocyanomethylthio) benzothiazole (CAS No. 21564-17-0); 2-4(-thiazolyl)benzimidazole (CAS No. 148-79-8).

It is an object of the present for the anti-microbial agents and/or anti-fungal agents to be placed on the examination paper.

DETAILED DESCRIPTION OF THE INVENTION

Figure 1:
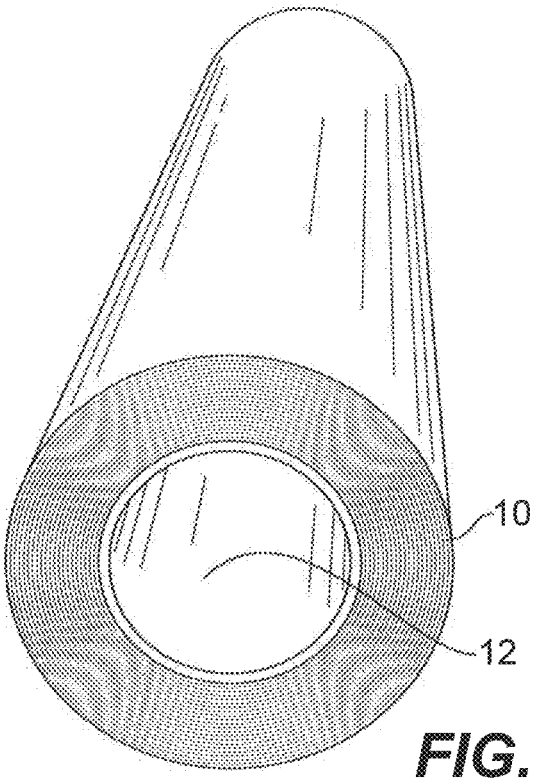
FIG. 1 Prior Art
FIG. 1 is a side view of a prior art medical examination paper roll.

FIG. 1 is a medical examination paper roll of the prior art comprising the medical examination paper 10 wound around a cardboard roll 12.

Figure 2:
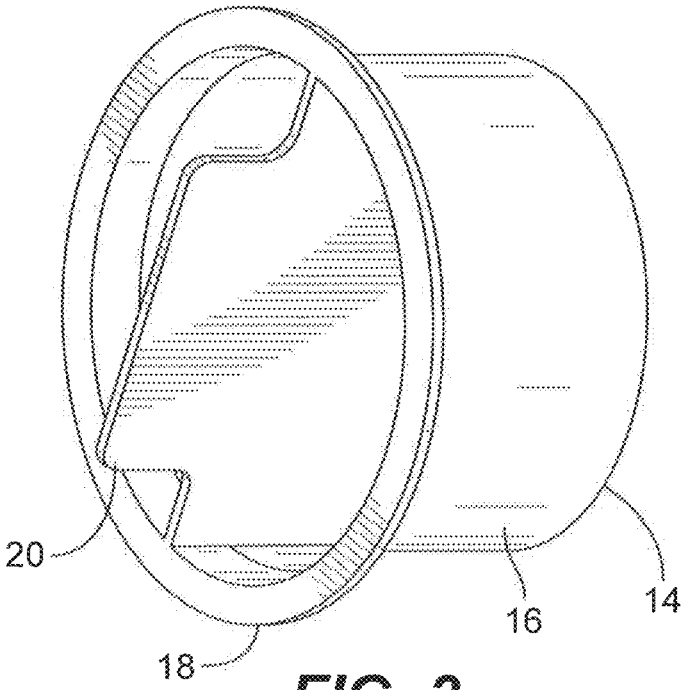
FIG. 2 is a side view of a device of the present invention.
Figure 3:
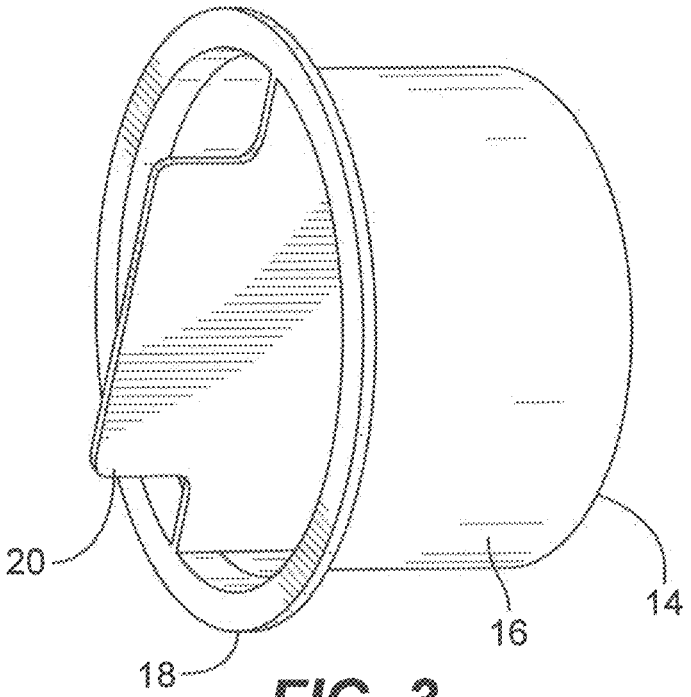
FIG. 3 is a side view of a device of the present invention.
Figure 4:
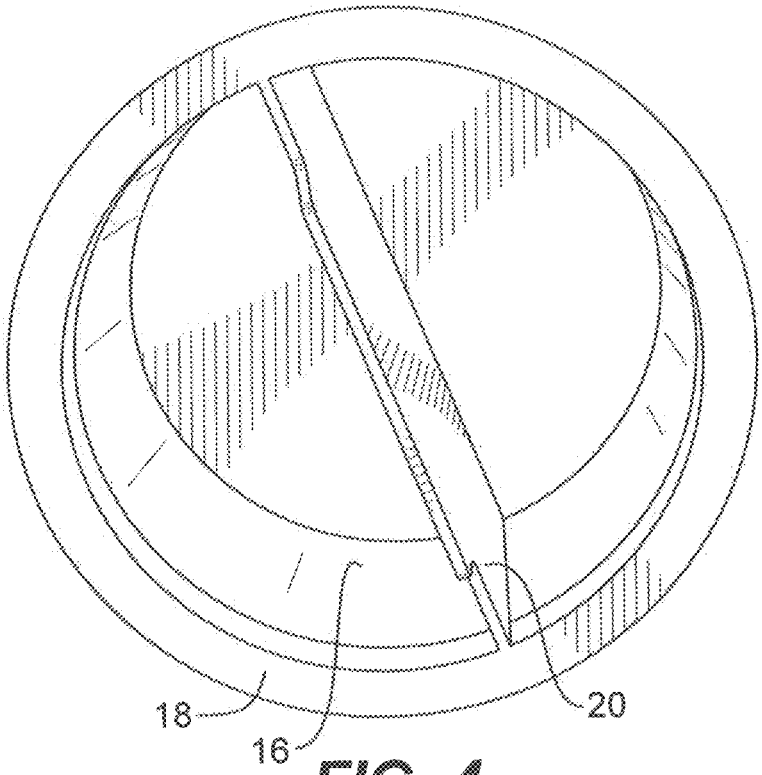
FIG. 4 is a top view of a device of the present invention.

FIGS. 2-4 show the device 14 that has a cylindrical section 16 that fits within the opening at the edges of the medical examination paper roll, and a collar 18 that abuts the outside edge of the medical examination paper roll. There is a gripping piece 20 that is within the cylindrical section 16 that can be used to grasp the device 14.

Figure 5:
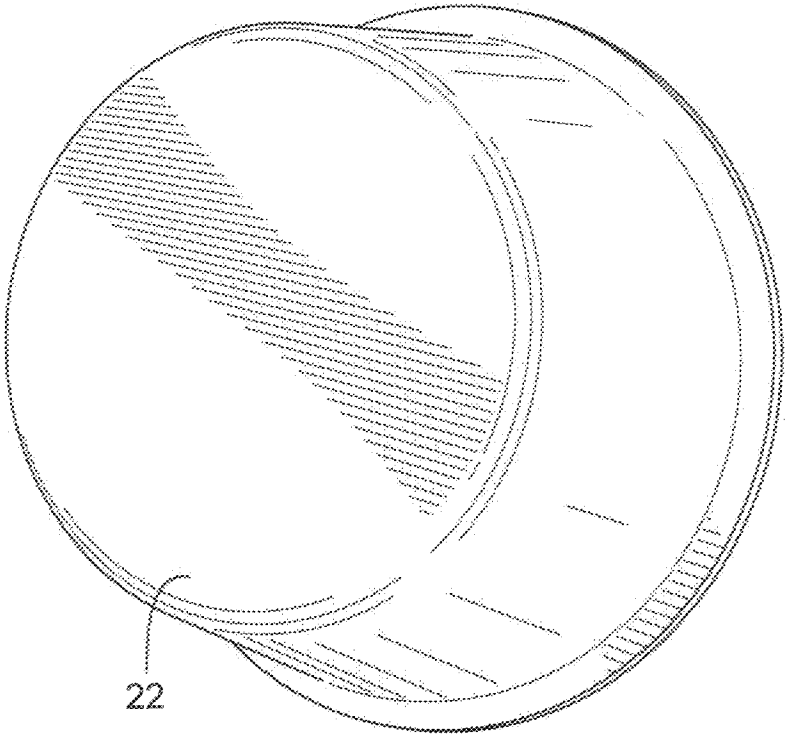
FIG. 5 is a bottom view of a device of the present invention.

FIG. 5 shows the bottom 22 of the device 14 that fits into each end of the inside diameter opening 26 of the medical examination paper roll.

Figure 6:
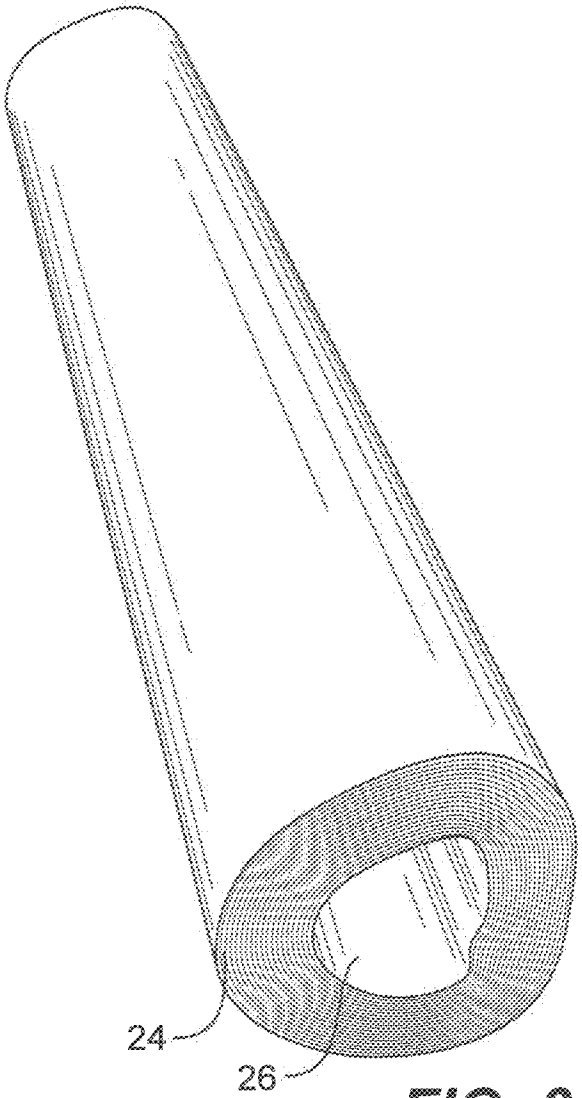
FIG. 6 is an edge view of a medical examination paper roll without any device in the center of the roll.
Figure 7:
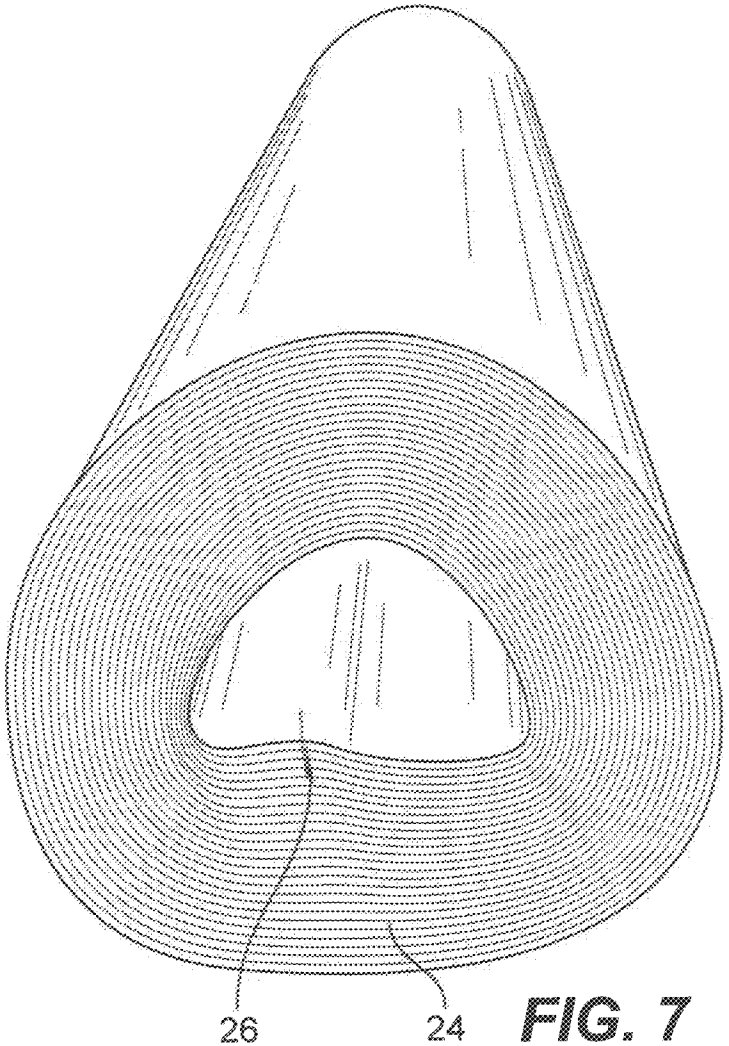
FIG. 7 is an edge view of a medical examination paper roll without any device in the center of the roll.

FIGS. 6 and 7 show that the paper roll is deforming inside the diameter 26.

Figure 8:
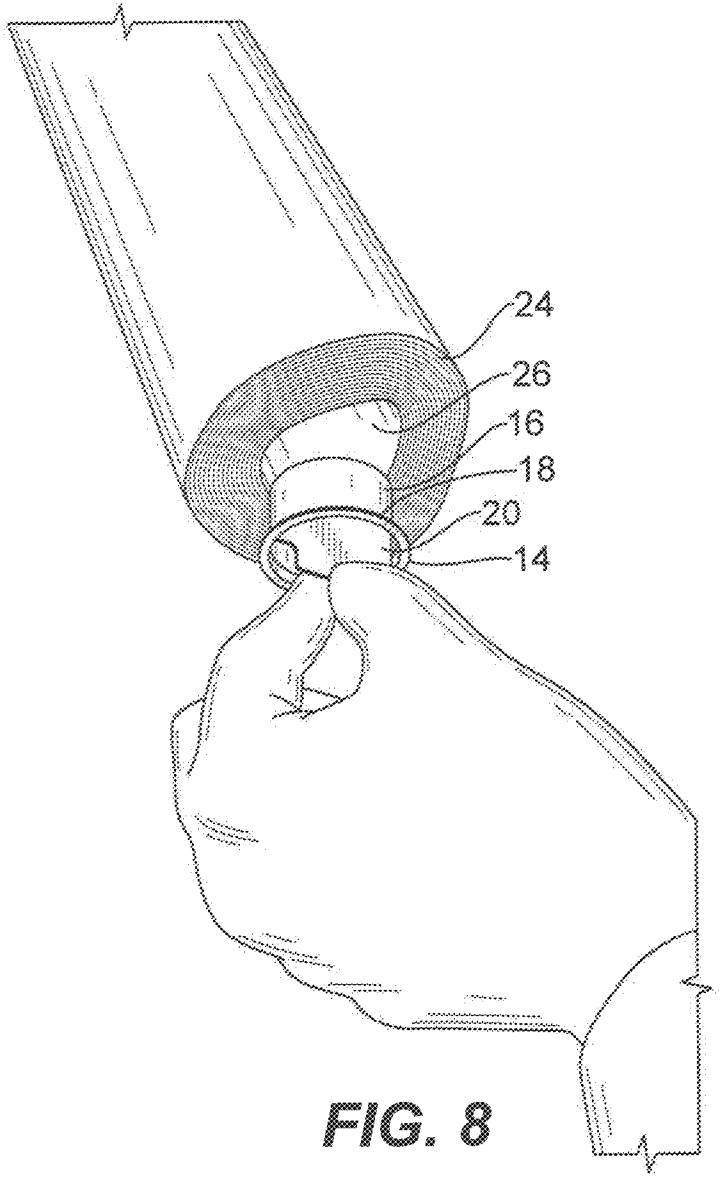
FIG. 8 is an edge view of a device of present invention being inserted in a medical examination paper roll that does not have the cardboard roll in the center.
Figure 9:
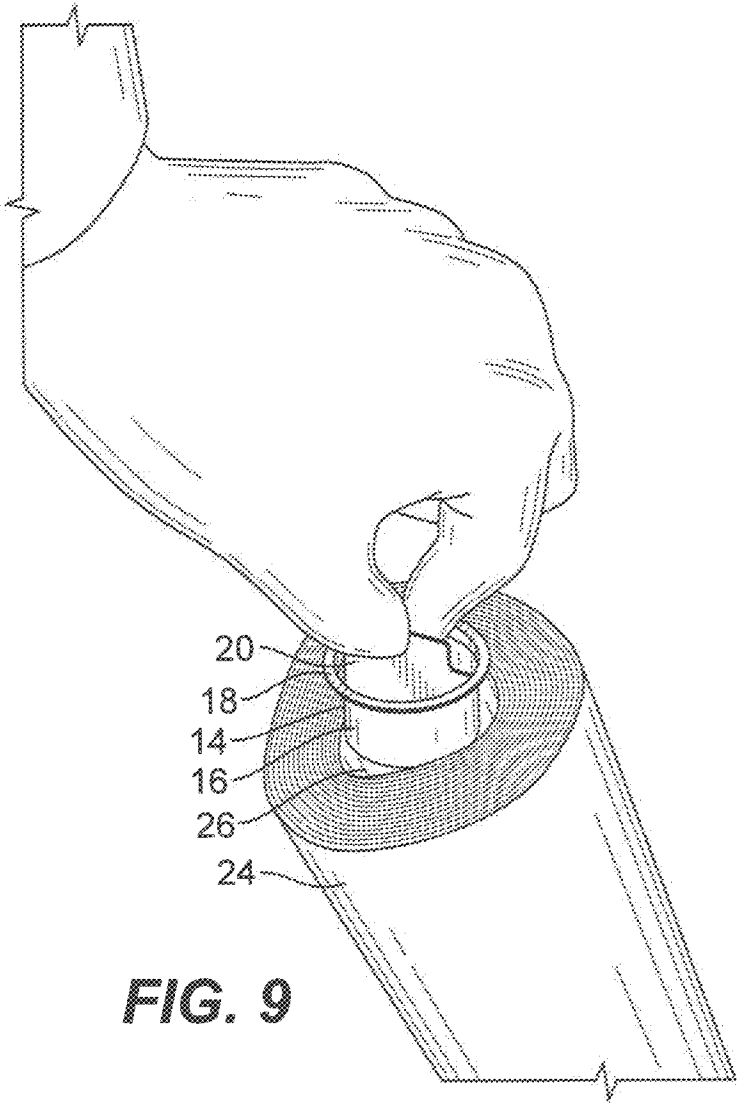
FIG. 9 is a side view of a device of a present invention being inserted in a medical examination paper roll that does not have the cardboard roll in the center.

FIGS. 8 and 9 show a user gripping the gripping piece 20 to insert the device 14 into the open inside diameter 26 of the medical examination paper roll 24. The cylinder 16 of the device 14 is inserted into each edge of the paper roll 24. The collar 18 abuts the outside edge of the paper roll 24.

Figure 10:
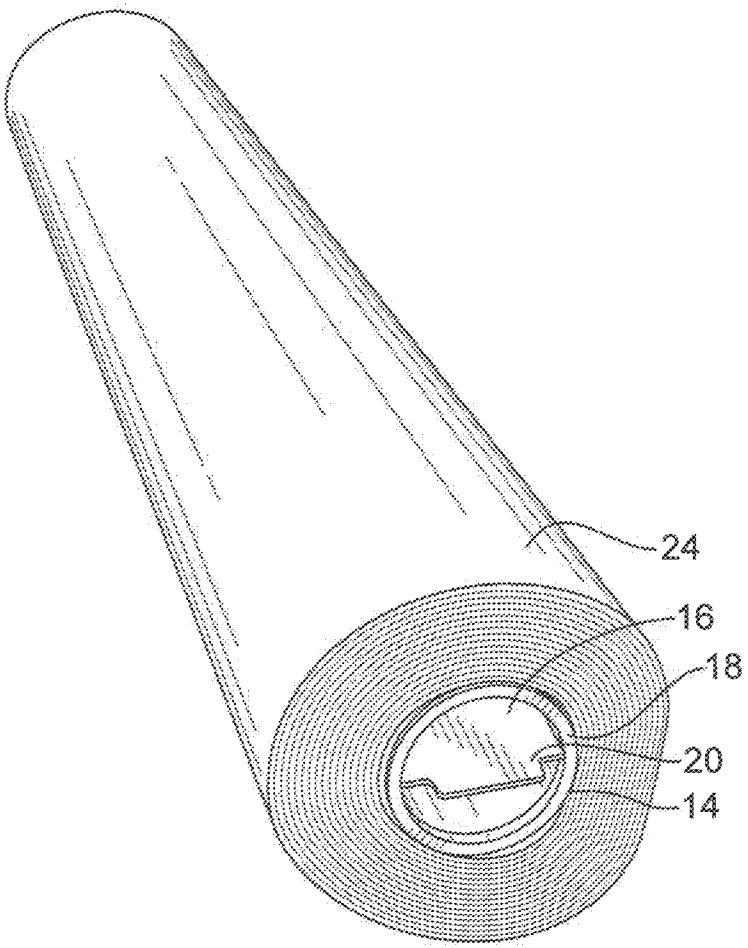
FIG. 10 is a side view of a device inserted in one side of the medical examination paper roll that does not have the cardboard roll in the center.

FIG. 10 shows a device 14 inserted into one end of the inside diameter of the medical examination paper roll 24. The device 14 comprises a cylinder 16, a collar 18 and a gripping piece 20.

Figure 11:
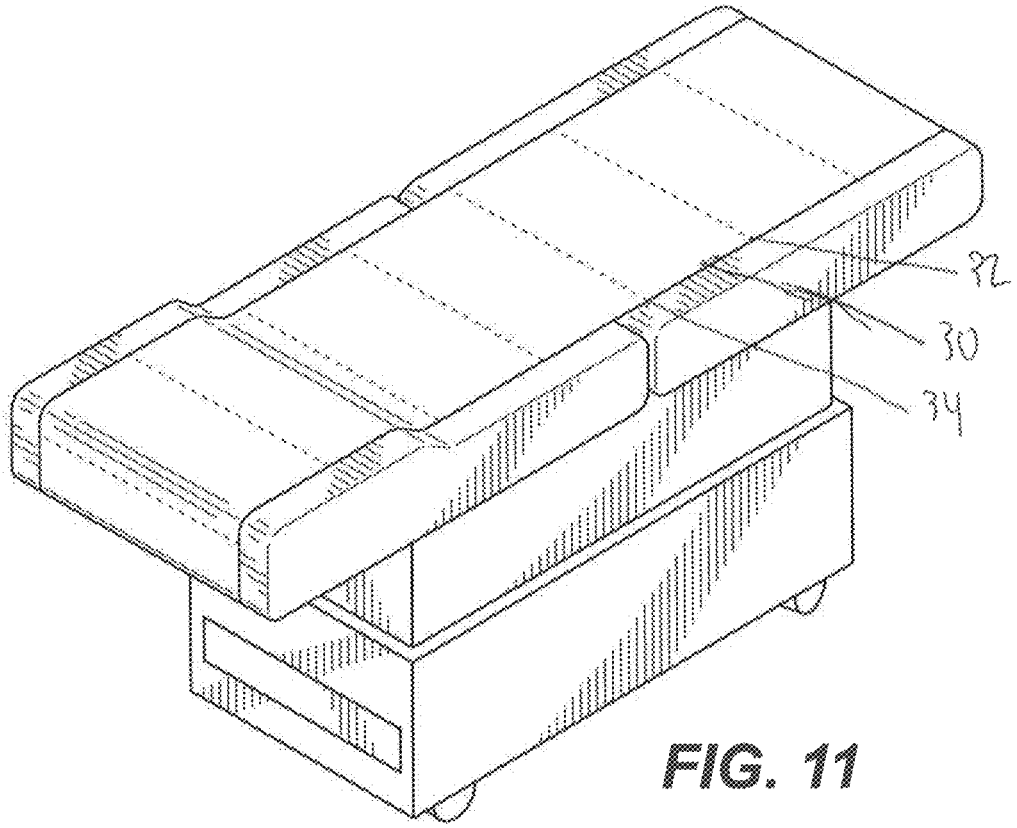
FIG. 11 is a top view of an embodiment of the medical examination paper on the examination table.
Figure 12:
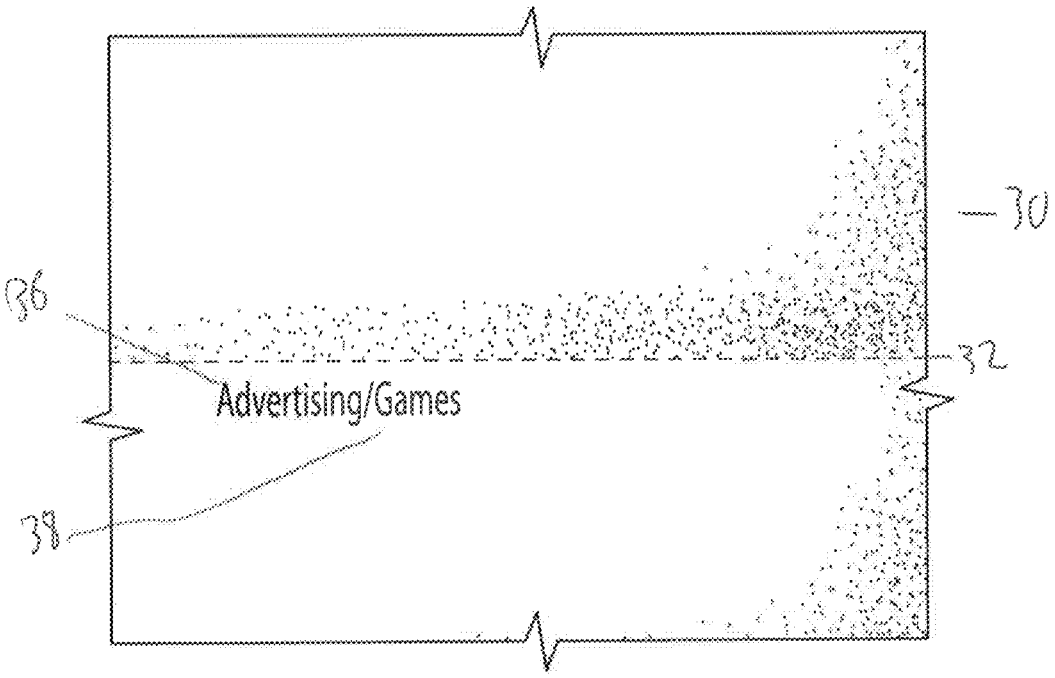
FIG. 12 is a top view of an embodiment of the medical examination paper.

FIGS. 11 and 12 show medical examination paper 30 having perforations 32 and 34, also having games or advertisements 36 and 38.

In an embodiment, a device is placed at each end of the opening of the roll of the medical examination paper. In an embodiment, the devices only go inside the opening a small distance, for example from about 1" to about 5". The purpose of the device is to keep the medical examination paper in its rolled form without collapsing until it is placed on the examining table at the doctor's office for dispensing.

In an embodiment, the roll of medical examination paper has perforations so that the paper can be torn easily. In an embodiment, the perforations are located at the same precise distance throughout the roll, for example at 6 foot integrals.

In an embodiment, advertising or games located on both sides of the perforations that are located on the medical examination paper, and no advertising or games are located beyond those locations. This way when a user is sits on the medical examination paper, they are not sitting on the advertising or games, but can read or interact with the advertising or games while they are sitting on the medical examination paper.

In an embodiment, an adhesive or other product is placed where the perforations are located on the underside of the medical examination paper, so that the paper can be attached to the table when the paper is placed on the table. In this way the paper does not move while the user is sitting on the paper, or when the paper is placed on the table.

In an embodiment, the medical examination paper is coated or impregnated with an anti-fungal and/or anti-microbial product for protecting the patient from possible contamination from unchanged medical examination paper.

In an embodiment, the anti-microbial/anti-fungal properties are derived from natural compounds that are extracted from plants. In an embodiment, the plants are lusianthrin and chrysin. In an embodiment, the compounds are chemical in nature.

The invention claimed is:

1. A medical examination paper roll comprising:

a roll of medical examination paper adapted for use on a medical examination table;

two devices inserted into openings of each edge of said roll;

wherein said roll does not have a cardboard core or other roll support within said medical examination paper roll that goes from one end of said medical examination paper roll to other end;

said two devices each comprising a gripping piece; a collar and a hollow cylindrical section in a single object;

said gripping piece being a linear flat piece within said hollow cylindrical section and said gripping piece permanently protrudes outside said collar to be gripped by a user;

said collar abuts an outside edge of said medical examination paper roll, which limits depth of insertion once said device is inserted in said roll;

said two devices only go inside said openings approximately 1" to approximately 5" from each of said edges of said roll;

said cylindrical section abutting inside of said roll;

said two devices previously inserted into said roll removed from said roll when said roll is attached to an examination table.

2. The medical examination paper roll of claim 1 wherein each of said two devices keep said medical examination paper roll in its rolled form without collapsing until said roll is placed on an examining table at a doctor's office for dispensing.

3. The medical examination paper roll of claim 1 wherein said roll of medical examination paper is shrink wrapped.

4. The medical examination paper of claim 3 further comprising marketing collateral placed under said shrink wrap and above said medical examination paper.

* * * * *